US006624796B1

(12) United States Patent
Talley et al.

(10) Patent No.: US 6,624,796 B1
(45) Date of Patent: Sep. 23, 2003

(54) SEMI-RIGID BENDABLE REFLECTING STRUCTURE

(75) Inventors: Eric Talley, Hamilton, NJ (US); William Davis Brokaw, Annandale, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/808,347

(22) Filed: Mar. 15, 2001

Related U.S. Application Data

(60) Provisional application No. 60/215,874, filed on Jun. 30, 2000.

(51) Int. Cl.[7] ..... H01Q 15/20
(52) U.S. Cl. ..... 343/915; 343/912
(58) Field of Search ..... 343/DIG. 2, 840, 343/880, 881, 912, 915, 916; H01Q 15/20

(56) References Cited

U.S. PATENT DOCUMENTS 3,406,404 A * 10/1968 Maier ..... 343/915
3,715,760 A * 2/1973 Palmer ..... 343/915
3,717,879 A * 2/1973 Ganssle ..... 343/915
4,529,277 A * 7/1985 Gee et al. ..... 350/613
4,646,102 A * 2/1987 Akaeda et al. ..... 343/915
4,989,015 A 1/1991 Chang
5,104,211 A 4/1992 Schumacher et al.
5,198,832 A * 3/1993 Higgins et al. ..... 343/915
5,255,006 A 10/1993 Pappas et al.
5,257,034 A 10/1993 Turner et al.
5,421,376 A 6/1995 Sinha
5,446,474 A 8/1995 Wade et al.
5,515,067 A 5/1996 Rits ..... 343/912
5,864,324 A 1/1999 Acker et al.

FOREIGN PATENT DOCUMENTS

EP 1 043 802 A2 10/2002

* cited by examiner

*Primary Examiner*—Tho Phan
(74) *Attorney, Agent, or Firm*—Townsend and Townsend and Crew LLP

(57) ABSTRACT

A deployable reflecting structure for use in space applications, preferably for RF antenna structures, includes at least one rigid section having a reflective surface and at least one bendable section having a reflective surface and being connected to the rigid section. The bendable section is movable between a first, stowed position in which the reflective surface of the bendable section is at least partially overlapping with the reflective surface of the rigid section, and a second, deployed position in which the reflective surfaces are continuous and non-overlapping.

20 Claims, 5 Drawing Sheets

SEMI-RIGID BENDABLE REFLECTING STRUCTURE

This application claims the benefit of provisional application Ser. No. 60/215,874 filed Jun. 30, 2000.

BACKGROUND OF THE INVENTION

The present invention relates generally to deployable antenna reflectors, and more specifically, to deployable reflectors having foldable elements that bend into space conserving positions. A reflecting structure according to the invention has at least one foldable, bendable element that has memory as to shape, such that when deployed, the foldable element adopts a predetermined, reflective shape.

DESCRIPTION OF THE RELATED ART

In most, if not all, space vehicles, some form of deployable antenna reflector is required. Most are required to be stowed in as compact a disposition as possible in order to save space on board the spacecraft for other components. In general, the antenna reflectors in a deployed state take up substantially more volume than in their stowed state. Various structures have been used in the past to accomplish the dual-states of being stowed and deployed, but each is believed to have one or more limiting features, either from a structural or performance standpoint, or from a cost and manufacturability one.

Examples of known reflectors include that which is described in U.S. Pat. No. 4,989,015 to Chang, wherein a deployable antenna has a rigid central truss which carries circumferentially spaced booms. The booms support a flexible mesh reflecting surface service, which in the deployed state, adopts a concave, paraboloid shape. The mesh may be connected to the front of a cable supporting structure by tying, bonding or other mechanical connectors.

Further examples include U.S. Pat. No. 5,104,211 to Schumacher et al., in which a deployable solar panel has a plurality of radially disposed ribs and interconnected truss structures supported from a central hub. The ribs support a semi-rigid reflective surface structure consisting of a plurality of thin, flat reflective panel strips. Overall, the ribs resemble the supporting structure of an umbrella. The reflective strips are made of a low mass graphite-epoxy over which a reflective coating, such as vapor deposited silver is formed.

Yet another example of prior deployable structures is seen U.S. Pat. No. 5,421,376 to Sinha, wherein a deployable parabolic reflector has a metalized mesh fabric reflecting surface. The reflectors can be used in mobile and portable ground stations. The reflector is deployed in a parabolic shape, and includes a plurality of panels supported on ribs.

Another wire mesh deployable antenna reflector is shown in U.S. Pat. No. 5,864,324, issued to Acker et al., wherein a mesh reflector is made of a woven mesh material supported on radially extending ribs. The ribs are telescopic so that the deployed antenna reflector is substantially larger in volume than when stowed.

U.S. Pat. No. 5,255,006 to Pappas et al. describes a collapsible satellite, apparatus, in which rigid panels are connected to a base. When the rigid panels are rotated outwardly from a stowed position, the apparatus adopts a parabolic shape suitable for use as an antenna reflector. A similar parabolic reflector is disclosed in U.S. Pat. No. 5,257,034 to Turner et al.

U.S. Pat. No. 5,446,474 to Wade at al. discloses a re-deployable and furlable rib reflector which is movable between stowed and deployed positions. The reflector includes a central hub to which are connected a plurality of ribs. A ring assembly brings the rib furling elements into contact with the ribs for furling or unfurling about the hub.

In various known devices described above, the mechanisms used for furling and unfurling the reflecting structures relatively complex; in general, the more mechanical parts, the more prone the apparatus will be to failure in terms of binding during deployment. Also, mesh reflectors, although effective, are expensive to produce due to the complexity of conforming the mesh to a parabolic or other concave shape. Thus, a continuing need exists for deployable reflective structures that are relatively simple in construction, with a minimum of moving, mechanical parts.

SUMMARY OF THE INVENTION

An object of the present invention is to provide a deployable reflector which has a minimal number of moving parts for moving deployable elements from a stowed position to a deployed position.

Another object of the present invention is to provide a deployable reflector that is relatively simple in construction and cost effective to produce.

Still another object of the present invention is to provide a reflector that is light weight, thermally stable, and stowable in a substantially smaller volume than its deployed volume.

These and other objects are met by providing a deployable reflector apparatus which includes at least one rigid section having a reflective surface and at least one bendable section having a reflective surface and being connected to the rigid section, the bendable section further being movable between a first, stowed position in which the reflective surface of the bendable section is at least partially overlapping with the reflective surface of the rigid section, and a second, deployed position in which the reflective surfaces are continuous and non-overlapping.

Preferably, the apparatus includes a single, continuous piece of reflective material having at least one section connected to, and thereby rigidized by, a stiffening member. The reflective material is bendable and provided with shape memory, such that when bent away from its original form, it naturally springs back to its original form when the bending forces are released. The bending forces never exceed the yield strength of the material.

These and other objects and features of the present invention will become more apparent from the following detailed description, drawings and claims.

DETAILED DESCRIPTION OF THE PREFERRED EMBODIMENTS

Figure 1:
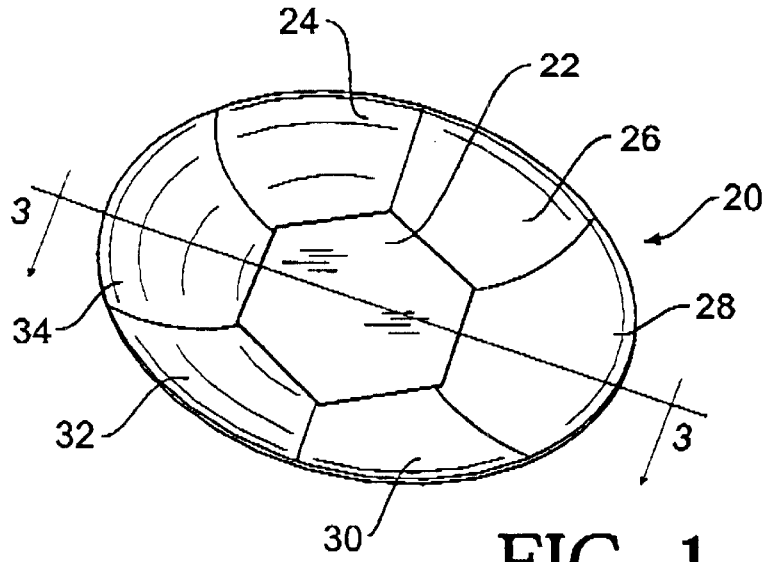
FIG. 1 is a front perspective view of a reflecting structure according to one embodiment of the present invention.
Figure 2:
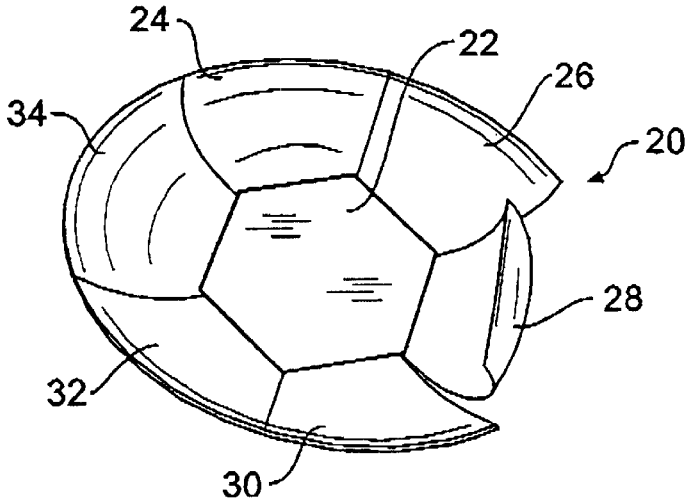
FIG. 2 is a view similar to FIG. 1, with one of the flexible panels shown in a semi-folded position.
Figure 3:
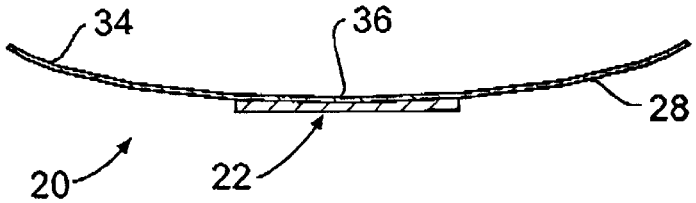
FIG. 3 is a cross-sectional view taken along line 3—3 of FIG. 1.

Referring to FIGS. 1–3, a reflecting structure 20 includes a reflecting, substantially parabolic surface having a plurality of sections, including a center section 22 and a plurality of bendable, flexible sections 24, 26, 28, 30, 32, and 34 extending radially from the center section 22. All sections of the reflecting surface can be formed from a single sheet of composite, reflecting material cut radially to form the generally hexagonally shaped flexible sections and center section. Alternatively, the flexible sections could be individually cut and separately attached to a rigid, center section. Although hexagonally shaped sections are shown, virtually any shape can be employed.

Whether or not the reflecting surface is made from a single sheet of material, the preferred material is a semi-rigid laminated composite having laminates of organic fibers, such as graphite, KEVLAR, glass or other structural fibers natural or synthetic. The laminated structure may be multiple layers each of parallel unidirectional fibers in which the layers are oriented to form a quasi-isotropic solid surface, or single or multiple layers comprised of tows of fibers woven in two, three or more axes, any of which are contained in a laminating resin such as a thermosetting or thermoplastic resin utilized in structural composites. The laminate may embed or otherwise may include reflective material suitable for reflecting RF signals.

The center section 22 is made rigid by attaching to its back surface a rigid center member 23, which may be made of a composite laminated structure of organic fibers, such as graphite, KEVLAR, glass or other structural fibers natural or synthetic. These may be in the form of multiple layers each of parallel unidirectional fibers in which the layers are oriented to form a quasi-isotropic solid surface or single or multiple woven layers comprised of tows (multiple strands) of fibers woven in two, three or more axes and contained in a laminating resin such as thermosetting or thermoplastic utilized in structural composites.

To achieve a desired degree of stiffness, the center member 23 can be made of the same material but with more laminations than the material used in the reflecting surface. Also, the center member 23 can be made of any suitable stiff material, such as a honeycomb composite, or may otherwise use materials that resist bending. It is preferable, however, to use a material that has a thermal expansion characteristic consistent with that of the reflecting material to avoid differential thermal expansion, which could lead to distortions in the shape of the structure.

FIG. 1 shows the reflecting structure 20 in a fully deployed position, exhibiting the reflective surface in a substantially parabolic shape. The overall diameter in outer space applications is preferably over three meters, and can be as large as 5–12 meters or larger; in applications of this magnitude, space savings are at a premium. In the stowed position, the individual bendable or flexible sections 24, 26, 28, 30, 32 and 34 are folded or bent over the center section 22, by analogy, as pedals of a flower. The bend radius is intended to stress the material to a point below the yield strength of the laminated material, so that when bent, the structure develops a spring restoring force. Moreover, the material that comprises the reflecting surface is "bendable" but retains "memory," in that the material retains its pre-folded or pre-bending shape.

When in the folded, stowed position, the flexible members 24, 26, 28, 30, 32, and 34 can be held down with any conventional means (not shown in FIGS. 1–3). For example, restraint of the individual sections can be provided through the use of KEVLAR organic cord that provides the necessary restraint during launch. Deployment of the reflector is accomplished by using a "hot knife" burn through cutter or more conventional pyrotechnic knife and severing the KEVLAR cording or use of a pin puller to release hold-down preload.

Present spacecraft requiring large RF antenna reflecting surfaces for communications typically utilize furlable metallic mesh parabolic reflectors. This invention would replace such reflectors with a structure that has comparable RF performance, but easier deployment, with less risk of binding or other complications due to the limited number of movable parts.

Referring to FIG. 3, when in the deployed position, the reflecting surface preferably forms a continuous, or curvilinear surface 36 of the desired shape, which in the embodiment of FIGS. 1–3 is substantially parabolic. Additional support members can be provided on the back of the individual flexible sections so that when in the deployed position, the sections will seek the parabolic shape. An example of additional support members is "carpenters tape" which is a steel measuring tape that has a slight "C" shape in cross section. This measuring tape remains rigid when placed in a straight line, but is capable of bending transversely. A more detailed description of the carpenters tape follows.

Figure 4:
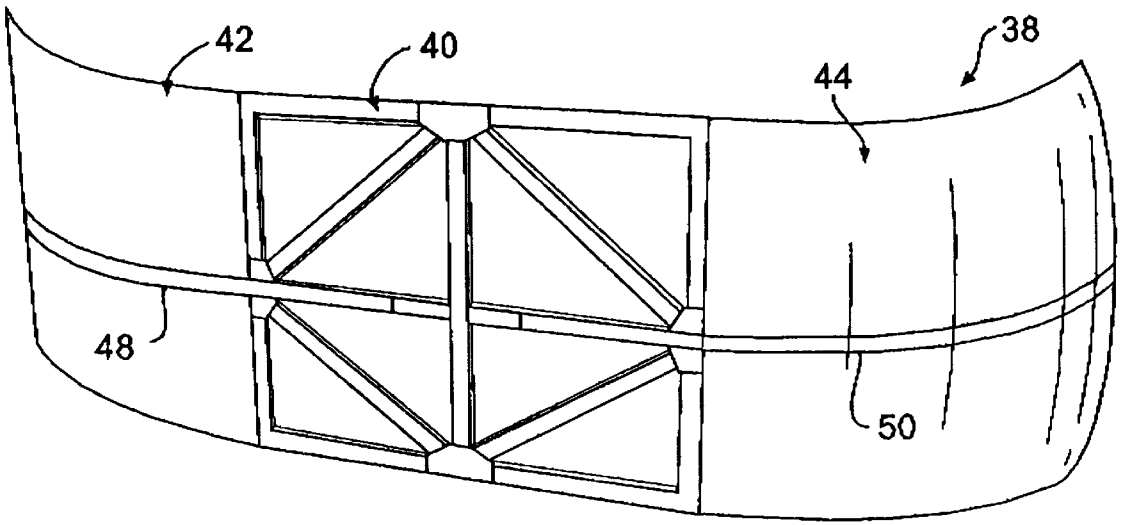
FIG. 4 is a rear perspective view of a reflecting structure according to another embodiment of the present invention.
Figure 5:
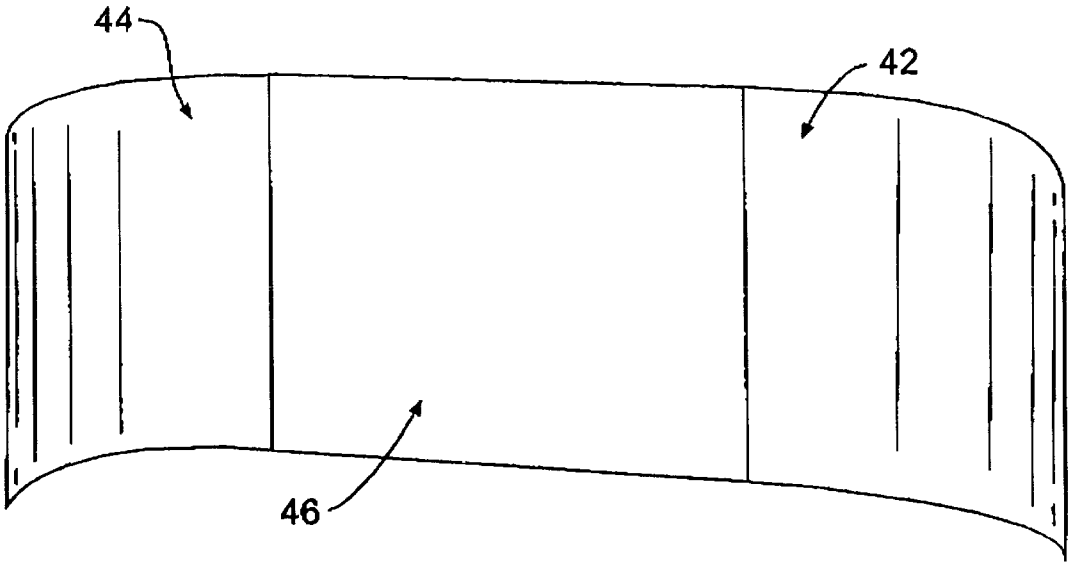
FIG. 5 is a front perspective view of the embodiment of FIG. 4.

Referring to FIGS. 4 and 5, which shows an alternative embodiment of the present invention, a reflecting structure 38 has three sections, including first and second, opposite side flexible sections 42 and 44, and a center section 46. Collectively the three sections define a continuous, preferably curvilinear reflecting surface. The center section is fixedly connected to a rigid support member 40, which is illustrated as a light weight, composite frame. The structure 38 is illustrated in the deployed position, in which the opposite side sections 42 and 44 are assisted in maintaining the deployed position by the use of strips 48 and 50 of carpenters tape. These strips easily bend when the sections 42 and 44 are in the stowed position (not illustrated) in which the side sections are folded over the center section 46. The tape can be connected to the back surface of the support member 40 and the sections 42 and 44 with any suitable mechanical means (such as fasteners), adhesive means or other suitable means.

The reflecting surface of the embodiment of FIGS. 4 and 5 is made of the same materials as in the embodiments of FIGS. 1–3. Essentially, the materials are selected to minimize differential thermal expansion, while minimizing weight and maximizing bend memory.

Figure 7:
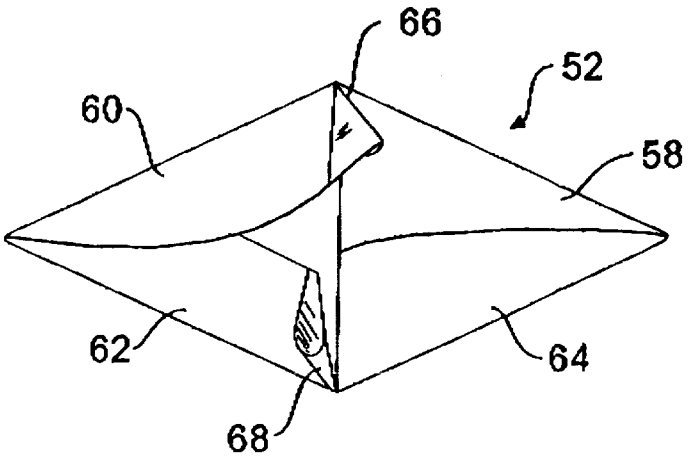
FIG. 7 is view similar to that of FIG. 6, with the flexible portions of the reflective surface folded or bent over the rigid sections.
Figure 8:
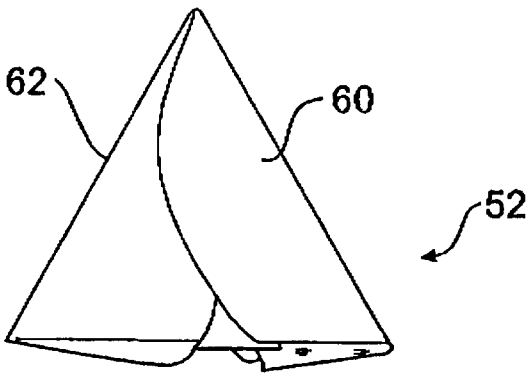
FIG. 8 is a view similar to that of FIGS. 6 and 7, but with the two rigid sections folded over top of each other, thus exhibiting a maximum space-saving disposition.
Figure 6:
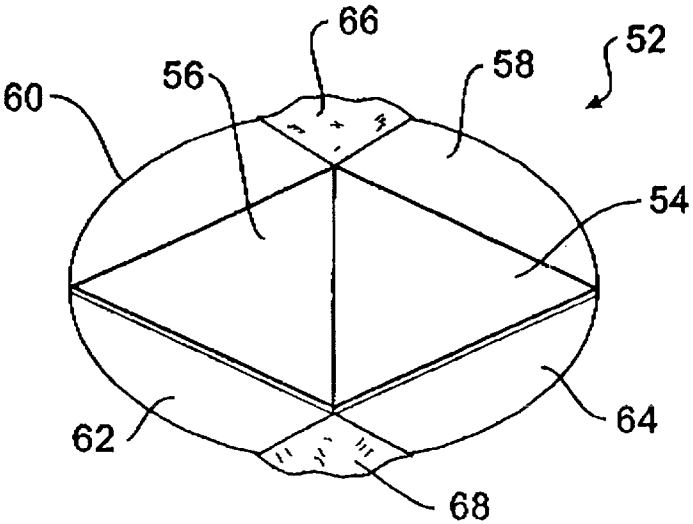
FIG. 6 is a rear perspective view of a reflecting structure according to another embodiment of the present invention, in a deployed position.

In the embodiment of FIGS. 6–8, a reflecting structure 52 has two rigid support members 54 and 56 which can be hinged together or simply juxtaposed. A sheet of reflecting material, shown to adopt the shape of a parabola, is fixedly connected to the two rigid support members, which are shown to be triangular in shape. Other shapes can be employed as well. FIG. 6 shows the structure 52 in the deployed position. To stow the structure, flexible sections 58, 60, 62 and 64 are folded over the rigid members 54 and 56. Comer portions of the reflecting surface are cutaway are replaced with flexible mesh joints 66 and 68, to facilitate folding yet to maintain RF reflecting characteristics when deployed.

FIG. 7 shows the structure 52 after the initial folding of the flexible sections. In FIG. 8, the rigid sections are folded onto each other, thereby further reducing the overall volume of the structure for the stowed position. Use of two separate rigid center support members thus permits a further reduction of the stowed volume, by means of folding about the center section. This can be done by providing a hinge between the two sections.

In any of the embodiments described herein, restraint of the stowed reflector is provided through the use of shear tie fittings with conventional pyrotechnic cable cutting devices strategically located at the hard points along the rigid backing structure of the center sections. Also, the flexible sections for any of the embodiments can be held using KEVLAR organic cord that provides the necessary restraint during launch.

Figure 9:
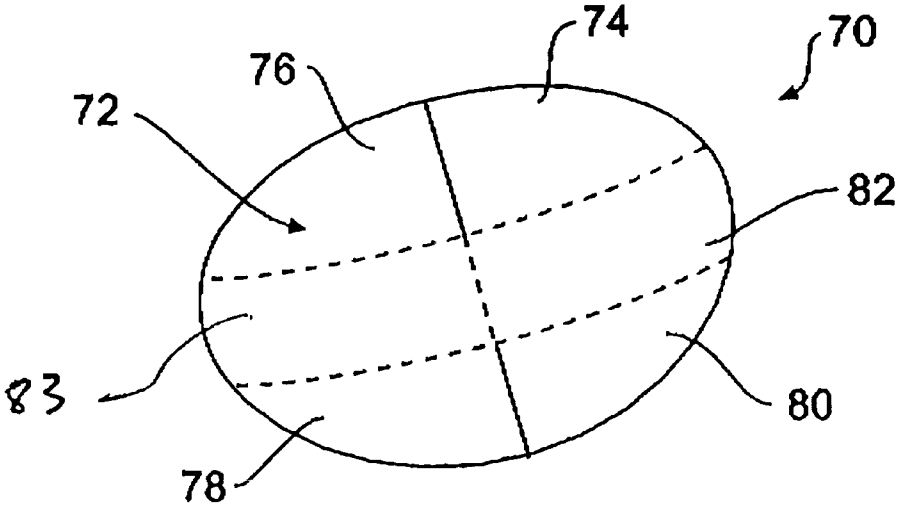
FIG. 9 is a front perspective view of another preferred embodiment of the present invention.
Figure 10:
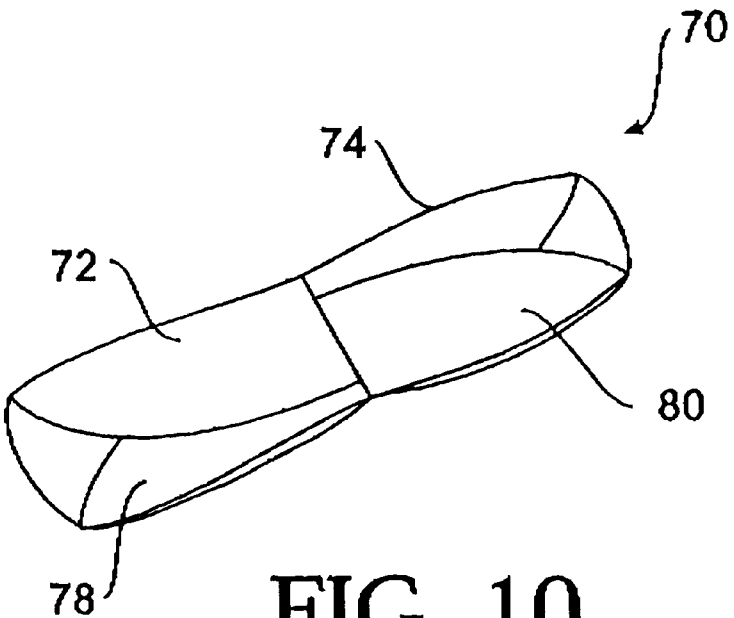
FIG. 10 is a view similar to that of FIG. 9, with the bendable or foldable sections of the reflective surface folded over the rigid sections.

FIGS. 9 and 10 illustrate yet another embodiment of a reflecting structure 70 having in its deployed position, a substantially parabolic reflecting surface 72 having rigid center sections 82 and 83 flanked by flexible sections 74, 76, 78, and 80. The center sections 82 and 83 are made rigid by fixedly connecting them to rigid support members (shown in broken lines) of the type used in the previously described embodiments. FIG. 10 shows the flexible sections folded over the rigid sections for adaptation of a stowed position. Further folding about the centerline between the two rigid members, as was done in the previous embodiment, can further reduce the volume of the structure in the stowed position.

Figure 11:
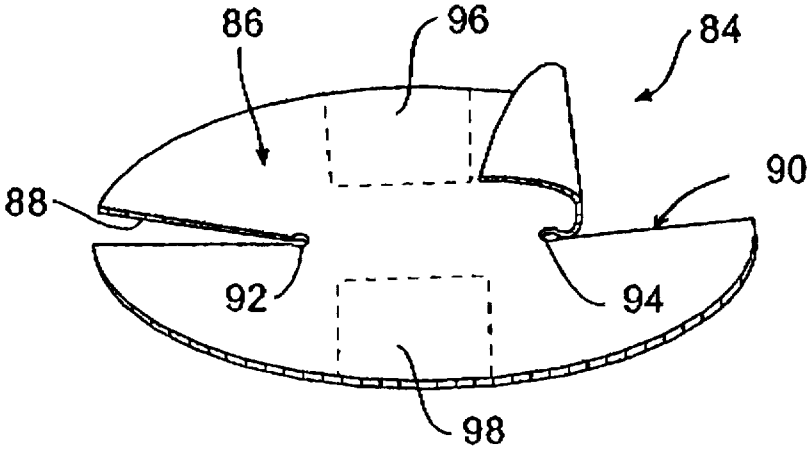
FIG. 11 is a front perspective view of a reflecting structure according to another embodiment of the present invention, with the reflecting surface in a deployed, substantially parabolic disposition.
Figure 12:
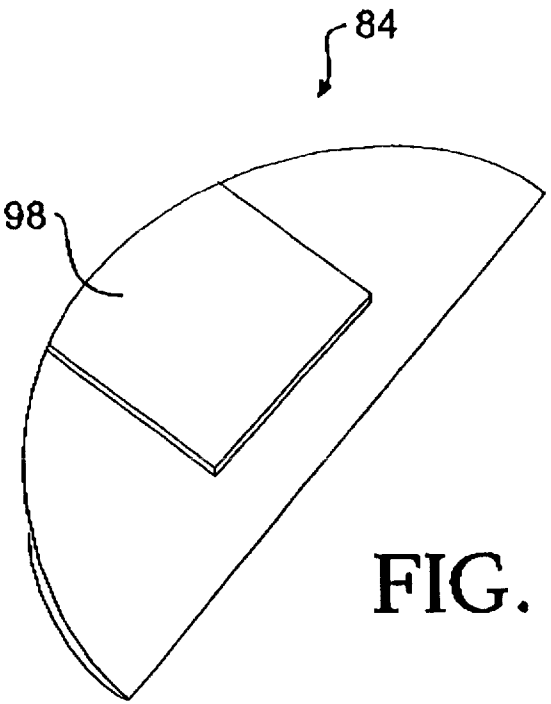
FIG. 12 is a view similar to that of FIG. 11, with the reflecting surface folded in half for the stowed position.

The embodiment of FIGS. 11 and 12 shows a reflecting structure 84 which includes a substantially parabolic sheet 86 of reflecting material. The material has two radial slits 88 and 90, each of which terminates inwardly in stress relief holes 92 and 94. The slits are substantially diametrically aligned with each other to define a fold axis. The reverse side of the reflecting surface 86 includes a pair of rigid support members 96 and 98 which help the surface adopt a substantially parabolic shape when released from its folded, stowed position.

FIG. 12 shows the structure 84 in the stowed position, in which the parabolic reflecting sheet 86 is folded in half about the fold axis defined by the two slits. Folding, as in the other embodiments, creates a restoring spring force which causes the structure to seek the parabolic shape when the structure is released from the bent condition. The release can take place using any of the conventional devices discussed above; when released, the reflecting surface springs into the desired shape. It is thus an aspect of the invention that the reflecting surface is one that is capable of providing a spring force when bent or folded, and one that can withstand a substantial amount of bending force without undergoing plastic deformation or exceeding the yield strength of the material.

What is claimed is:

1. A reflecting structure comprising:

at least one rigid section having a reflective surface; and at least one bendable section having a reflective surface and being connected to the rigid section at a connection region, the at least one bendable section comprising a flexible material;

wherein the at least one bendable section is movable between a stowed position in which the reflective surface of the at least one bendable section is at least partially overlapping with the reflective surface of the at least one rigid section, and a deployed position in which the reflective surfaces of the at least one bendable section and the at least one rigid section are continuous and non-overlapping; and wherein the at least one bendable section is movable between the stowed position and the deployed position by bending of the flexible material of the at least one bendable section in the connection region.

2. The reflecting structure of claim 1 wherein the reflective surfaces of the at least one rigid section and the at least one bendable section are made substantially from a single sheet of RF reflecting material.

3. The reflecting structure of claim 2 wherein the RF reflecting material comprises a laminated, composite material.

4. The reflecting structure of claim 3 wherein the at least one rigid section comprises additional laminations of the composite material as compared to the at least one bendable section.

5. The reflecting structure of claim 1 further comprising a rigid support member connected to the at least one rigid section opposite the reflective surface thereof.

6. The reflecting structure of claim 5 wherein the rigid support member and the at least one rigid section comprise materials having compatible thermal expansion characteristics.

7. The reflecting structure of claim 1 wherein the at least one rigid section comprises a centrally located rigid section, wherein the at least one bendable section comprises a first flexible section connected to one side of the centrally located rigid section and a second flexible section connected to an opposite side of the centrally located rigid section, and wherein the first and second flexible sections are folded substantially over the rigid section in the stowed position.

8. The reflecting structure of claim 7 further comprising a stiffening member connected to the first and second flexible sections to stiffen and support the first and second flexible sections in the deployed position.

9. The reflecting structure of claim 8 wherein the stiffening member comprises a strip of material having a convexity in cross section and being bendable in a first direction but stiff in a second direction which is substantially transverse to the first direction.

10. The reflecting structure of claim 1 wherein the at least one rigid section comprises a single, central rigid section; and wherein the at least one bendable section comprises a plurality of radially spaced flexible sections connected to and extending outwardly from the central rigid section in the deployed position, and being folded over the central rigid section in the stowed position.

11. The reflecting structure of claim 10 wherein the central rigid section and the plurality of flexible sections are integrally formed from a single sheet of reflecting material.

12. The reflecting structure of claim 1 wherein the at least one bendable section is movable from the stowed position to the deployed position by a spring restoration force generated from bending of the flexible material of the at least one bendable section.

13. A method of deploying a reflecting structure including least one rigid section having a reflective surface and at least one bendable section having a reflective surface and being connected to the at least one rigid section at a connection region, the at least one bendable section comprising a flexible material, the method comprising:

folding the at least one bendable section into a folded position over the at least one rigid section to generate a spring restoration force from bending of the flexible material of the at least one bendable section in the connection region;

holding the at least one bendable section in the folded position; and releasing the at least one bendable section to allow the spring restoration force to return the at least one bendable section from the folded position to a deployed position.

14. The method of claim 13 wherein the reflective surfaces of the at least one rigid section and the at least one bendable section are made substantially from a single sheet of RF reflecting material.

15. The method of claim 13 wherein the folding occurs on earth and the releasing occurs when the reflecting structure is in space.

16. The method of claim 13 wherein the reflecting structure adopts a generally parabolic shape in the deployed position.

17. The method of claim 13 wherein the at least one rigid section comprises a centrally located rigid section, wherein the at least one bendable section comprises a first flexible section connected to one side of the centrally located rigid section and a second flexible section connected to an opposite side of the centrally located rigid section, and wherein the folding comprises folding the first and second flexible sections substantially over the rigid section in the folded position.

18. The method of claim 17 further comprising stiffening and supporting the first and second flexible sections in the deployed position.

19. The method of claim 18 wherein stiffening and supporting the first and second flexible sections comprises connecting to the first and second flexible sections a strip of material having a convexity in cross section and being bendable in a first direction but stiff in a second direction which is substantially transverse to the first direction.

20. The method of claim 13 wherein the at least one rigid section comprises a single, central rigid section; wherein the at least one bendable section comprises a plurality of radially spaced flexible sections connected to and extending outwardly from the central rigid section in the deployed position; and wherein the folding comprises folding the plurality of flexible sections over the central rigid section in the folded position.

* * * * *